US010301753B2

(12) United States Patent
Iwasaki et al.

(10) Patent No.: US 10,301,753 B2
(45) Date of Patent: May 28, 2019

(54) PRESSER FOOT FOR SEWING MACHINE

(71) Applicant: CLOVER MFG. CO., LTD., Osaka-shi, Osaka (JP)

(72) Inventors: Chihiro Iwasaki, Osaka (JP); Yuji Kawasaki, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 0 days.

(21) Appl. No.: 15/787,210

(22) Filed: Oct. 18, 2017

(65) Prior Publication Data

US 2019/0112738 A1 Apr. 18, 2019

(51) Int. Cl.
*D05B 29/08* (2006.01)
*D05B 29/12* (2006.01)

(52) U.S. Cl.
CPC ..... *D05B 29/08* (2013.01); *D05B 29/12* (2013.01)

(58) Field of Classification Search
CPC ..... D05B 29/04; D05B 29/08; D05B 29/12
See application file for complete search history.

(56) References Cited

U.S. PATENT DOCUMENTS 1,468,934 A * 9/1923 Tyd ..... D05B 29/00 112/235
2,372,263 A * 3/1945 Eudy ..... D05B 35/062 112/139
2,556,406 A * 6/1951 Wapner ..... D05B 29/00 112/235
3,370,559 A * 2/1968 Longcore ..... D05B 29/08 112/151
4,181,087 A * 1/1980 Brauch ..... D05B 3/24 112/475.25
4,532,874 A * 8/1985 Eguchi ..... D05B 29/06 112/151
5,335,612 A * 8/1994 Cizek ..... D05B 29/08 112/150
5,566,631 A * 10/1996 Reinhart ..... D05B 29/06 112/235
5,791,273 A * 8/1998 Sakino ..... D05B 83/00 112/261

FOREIGN PATENT DOCUMENTS

CH 591591 A5 * 9/1977 ..... D05B 29/00
GB 1498908 A * 1/1978 ..... B22F 3/04
JP 08196761 A * 8/1996
JP 2013-215364 A 10/2013

* cited by examiner

*Primary Examiner* — Danny Worrell
(74) *Attorney, Agent, or Firm* — Hamre, Schumann, Mueller & Larson, P.C.

(57) ABSTRACT

A presser foot for a sewing machine has a bottom wall, first and second side walls, and a guard piece. The bottom wall has front and rear ends. In addition, the bottom wall is provided with a needle-passing hole and a first slit extending from the needle-passing hole to the front end. The first side wall and the second side wall are formed integral with the bottom wall and spaced apart from each other in a width direction of the bottom wall. The guard piece is attached to the first side wall to cover the gap between the first side wall and the second side wall from above. In plan view, the guard piece is spaced from the needle-passing hole and does not overlap with the needle-passing hole. The guard piece and the second side wall are spaced apart from each other by a second slit.

6 Claims, 4 Drawing Sheets

PRESSER FOOT FOR SEWING MACHINE

FIELD

The present disclosure relates to a presser foot for a sewing machine.

BACKGROUND

Conventionally, a sewing machine may be used to sew fabric generally in the following way. First, in preparatory work, an upper thread is threaded through a sewing-machine needle, a bobbin (wound with a lower thread) is set in place, and so on. After preparatory work, fabric is held down by a "presser foot" and fed in a predetermined direction while the sewing-machine needle is moved up and down. In this way, desired stitches are sewn.

While using a sewing machine, the sewer may place his/her hand near the presser foot (i.e., near the sewing-machine needle). To prevent injuries to sewer's fingertips from the sewing-machine needle, it has been suggested to attach a guard member to the presser foot (see JP-A-2013-215364). The conventional guard member is formed from a wire-like metal part and has room for improvement for protection of fingertips.

SUMMARY

The present disclosure has been presented under the above-noted circumstances and aims to provide a presser foot for a sewing machine capable of more reliably preventing fingertip injuries from a sewing-machine needle.

A presser foot for a sewing machine provided according to an aspect of the present disclosure may have a bottom wall, a first side wall, a second side wall and a guard piece. The bottom wall has a front end and a rear end. In addition, the bottom wall is formed with a needle-passing hole and a first slit extending from the needle-passing hole to the front end. The first side wall and the second side wall are formed integral with the bottom wall and spaced from each other. The guard piece is attached to the first side wall to cover a gap between the first side wall and the second side wall from above. The guard piece is spaced from the needle-passing hole in plan view. Further, the guard piece and the second side wall are spaced apart from each other by a second slit.

Other features and advantages of the present disclosure will become apparent from the detailed description given below with reference to the accompanying drawings.

EMBODIMENTS

Figure 1:
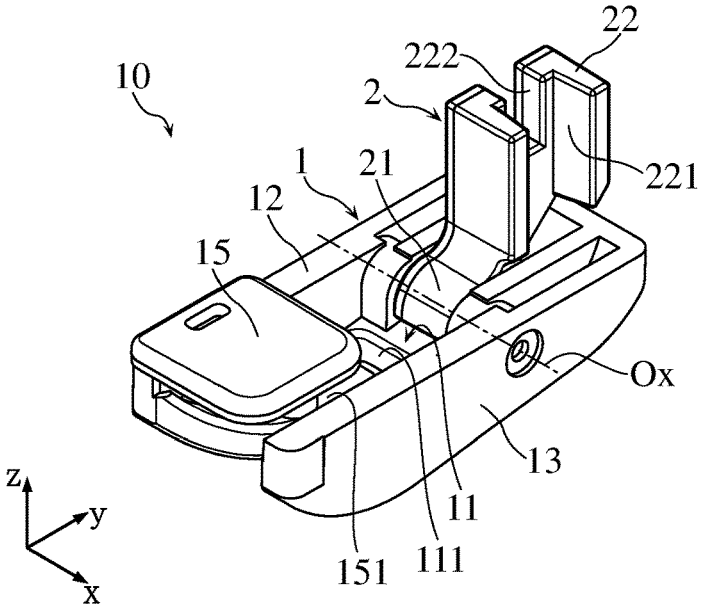
FIG. 1 is a perspective view of a presser foot for a sewing machine, according to an embodiment.

The following describes embodiments of a presser foot for a sewing machine with reference to the accompanying drawings.

FIGS. 1 to 7 show a presser foot for a sewing machine according to one embodiment. The presser foot 10 for a sewing machine (hereinafter, simply "presser foot 10") shown in the figures includes a body 1 and a holder 2 connected to the body 1. The body 1 has a bottom wall 11, a pair of side walls 12 and 13, a support wall 14 and a guard piece 15.

The bottom wall 11 is a section that holds fabric down while sewing. The bottom wall 11 is substantially flat, except at a curved portion (or an inclined portion), which will be described later. The bottom wall 11 is provided with a needle-passing hole 111, which allows the sewing-machine needle to move up and down, and a first slit 112.

The needle-passing hole 111 penetrates through the bottom wall 11 in a thickness direction (direction z). The needle-passing hole 111 is elongated in a lateral direction (direction x). The presser foot 10 having the elongated needle-passing hole 111 is usable for stitches with a stitch width in the lateral direction (such as zigzag stitches). Alternatively, a presser foot specifically designed for straight stitches, may have a needle-passing hole not elongated in the direction x (instead, substantially circular for example).

Figure 4:
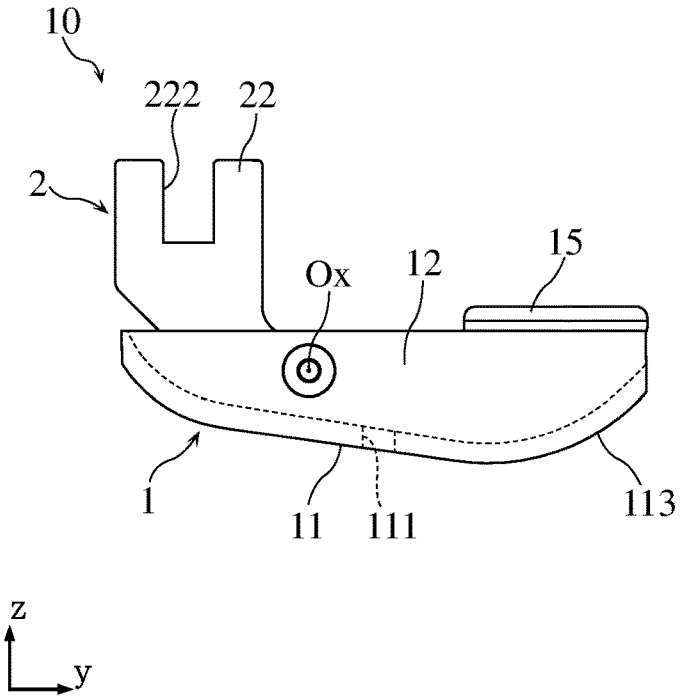
FIG. 4 is a side view of the presser foot for a sewing machine.
Figure 7:
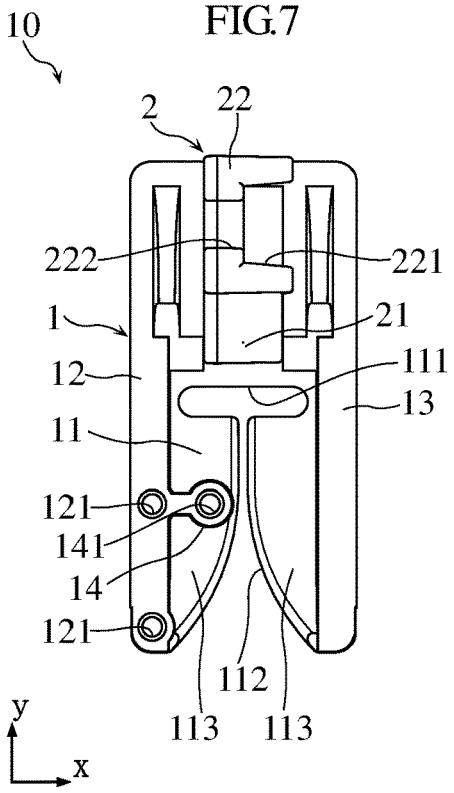
FIG. 7 is a plan view of the presser foot for a sewing machine, with a guard piece removed.

The first slit 112 communicates with the needle-passing hole 111 and extends forward (downward in FIG. 2) from the needle-passing hole to the front end of the body 1 (bottom wall 11). In plan view (as seen in the direction z), the first slit 112 has a center line coinciding with the center of the bottom wall 11 in the direction x. As shown in FIG. 7, the first slit 112 includes a first portion having a constant (or substantially constant) width (gap in the direction x) and a second portion having a width increased toward the front. The first portion is a linear portion directly communicates with the needle-passing hole 111, whereas the flared second portion is connected to the needle-passing hole 111 through the first portion. The bottom wall 11 has two front ends 113 spaced from each other in the direction x across the second portion of the first slit 112. As shown in FIG. 4, each front end 113 is raised higher toward the front. This configuration can be realized by smoothly curving each front end 113 as shown in FIG. 4. Alternatively, each front end 113 may be linearly inclined relative to the other portion of the bottom wall 11.

In one example, the bottom wall 11 has a thickness of 2 to 3.5 mm, a width (dimension in the direction x) of 15 to 20 mm and a length (dimension in the direction y) of 30 to 40 mm. These dimensions are shown merely by way of example and may be set appropriately depending, for example, on the properties (thickness, elasticity and so on) of the fabric to be sewn and the type of sewing-machine needle used.

Figure 5:
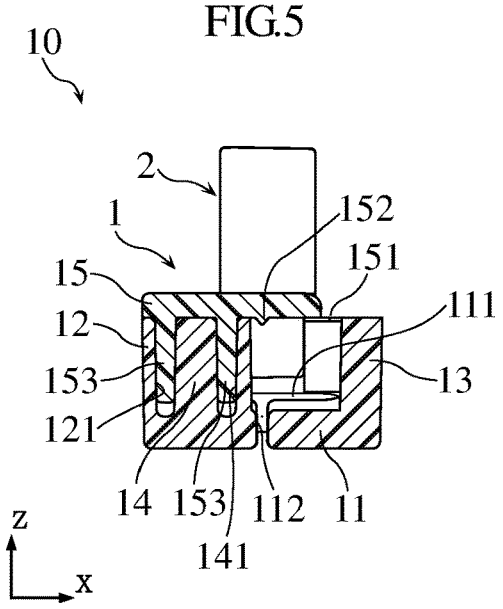
FIG. 5 is a sectional view along line V-V of FIG. 2.

The side walls 12 and 13 are spaced from each other in the direction x. Each of the walls 12 and 13 is formed integral with the upper surface of the bottom wall 11 to extend upward from the bottom wall 11. As shown in FIG. 5, each of the side walls 12 and 13 meets the bottom wall 11 at an angle of 90°, for example. In addition, the left-side surface (outer surface) of the side wall 12 as seen in the figure is flush with the left-side surface of the bottom wall 11. Similarly, the right-side surface (outer surface) of the side wall 13 is flush with the right-side surface of the bottom wall 11. In this manner, the present embodiment provides the side walls 12 and 13 standing on the respective edges of the bottom wall 11. Note, however, that the present disclosure is not limited thereto.

As shown in FIG. 1 or FIG. 4, the side walls 12 and 13 extend longitudinally in the direction y substantially from the front end to the rear end of the bottom wall 11 (and thus of the body 1). As can be seen from FIG. 4, the side walls 12 and 13 have a varying height (dimension measured in the direction z from the upper surface of the bottom wall 11) along, for example, the direction y. As will be described later with reference to FIG. 8, the height of the side walls 12 and 13 is determined so as not to leave a large gap between the upper end of the side wall (upper end face) and the highest position of the needle tip.

In one example, the side walls 12 and 13 have a height varying from a minimum value of 0 to 1 mm to a maximum value of 6 to 7 mm. The height of the side walls 12 and 13 may be 5 to 6 mm at a position corresponding to the needle-passing hole 111 in the direction y (see FIG. 4). In addition, the dimension measured at the same position from the lower surface of the bottom wall 11 to the upper edge of the side walls 12 and 13 may be 7 to 8 mm. These dimensions are also shown merely by way of example and may be set appropriately depending on the actual applications.

Figure 6:
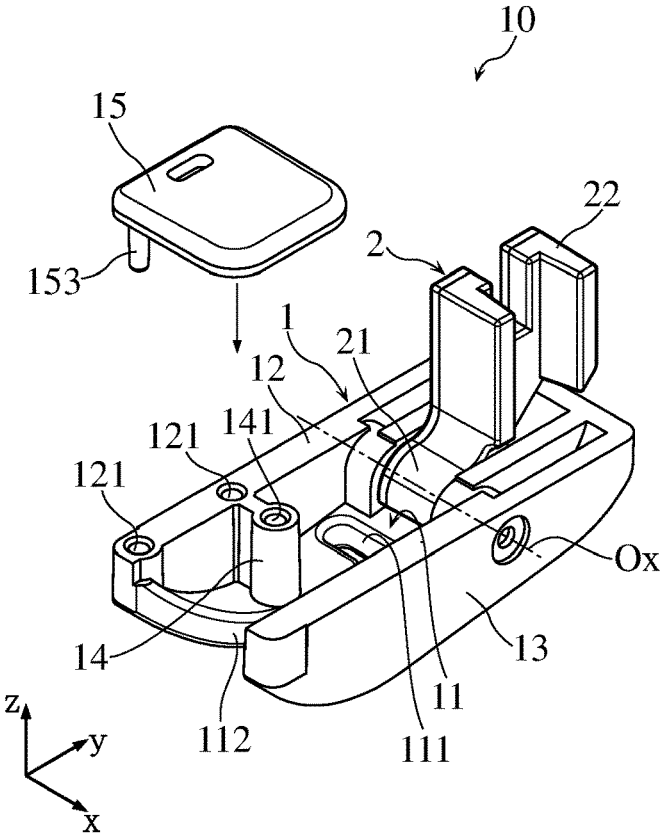
FIG. 6 is an exploded perspective view of the presser foot for a sewing machine.

As shown in FIGS. 5 to 7, the side wall 12 has two fixing holes 121. The fixing holes 121 are spaced from each other in the direction y at a position forward of the needle-passing hole 111. As can be seen from FIG. 5, each fixing hole 121 has a predetermined depth from the upper end of the side wall 12 (without penetrating through the bottom wall 11).

As shown in FIGS. 6 and 7, the support wall 14 is connected to the bottom wall 11 and the side wall 12. The support wall 14 extends from a position on the side wall 12 (corresponding to the rear one of the fixing holes 121) toward the side wall 13 and terminates ahead of the first slit 112 (FIG. 7). The support wall 14 is provided with a fixing hole 141. As shown in FIG. 7, the fixing hole 141 may be located near the first slit 112. The fixing hole 141 has a predetermined depth from the upper end of the support wall 14 (without penetrating through the bottom wall 11). In one example, the depth of the fixing hole 141 is equal to the depth of the rear fixing hole 121.

Figure 2:
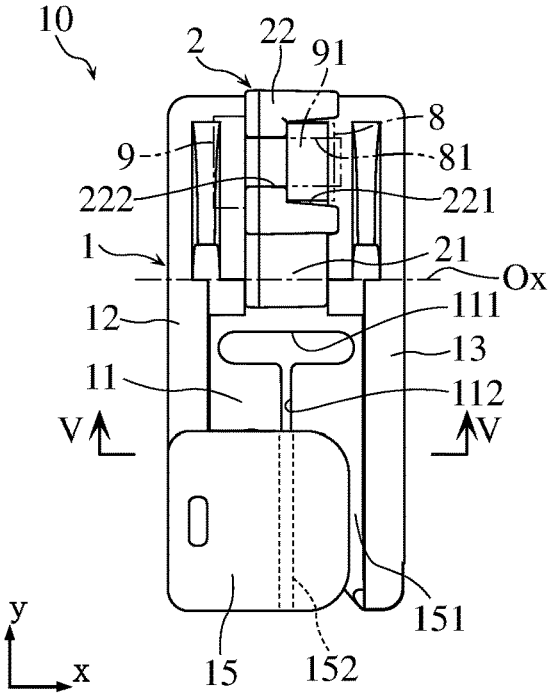
FIG. 2 is a plan view of the presser foot for a sewing machine.

The guard piece 15 is generally a flat plate and attached to the side wall 12 to cover the gap between the pair of side walls 12 and 13 from above. As shown in e.g., FIGS. 1 and 2, the guard piece 15 is located at the front of the body 1. In one example, the guard piece 15 has a front end face substantially flush with the front end face of the side wall 12. Alternatively, the guard piece may slightly project forward beyond the front end face of the side wall 12 (see FIG. 4). In plan view (see FIG. 2), the rear end face of the guard piece 15 is located forward of the needle-passing hole 111. Hence, the guard piece 15 does not overlap with the needle-passing hole 111 in plan view. On the other hand, the guard piece 15 overlaps with most of the flared portion (the second portion described above) of the first slit 112. As shown in FIG. 2, the guard piece 15 extends from the side wall 12 toward the side wall 13 and terminates short of the side wall 13. This configuration leaves a gap (hereinafter, "second slit 151") extending in the direction y between the guard piece 15 and the side wall 13. That is, the guard piece 15 is spaced from the side wall 13 by the second slit 151. In plan view, the second slit 151 is parallel to the straight portion (first portion) of the first slit 112. Unlike the present embodiment, the guard piece 15 may be attached to the side wall 13 so that the second slit 151 may be provided along the side wall 12.

Figure 3:
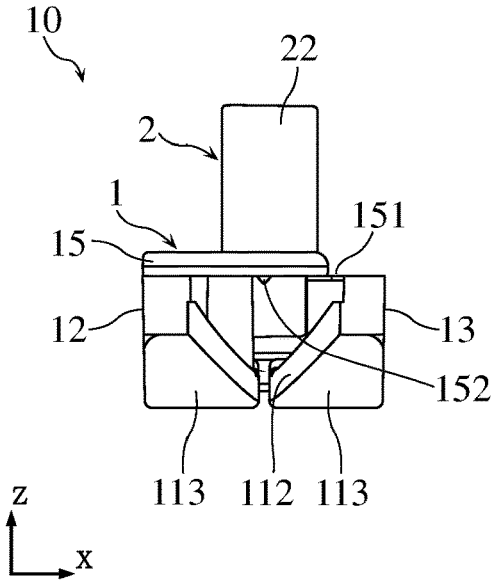
FIG. 3 is a front view of the presser foot for a sewing machine.

As shown in FIGS. 2 and 3, the guard piece 15 is provided with a center-position indicator 152 having an elongated shape. In the present embodiment, the center-position indicator 152 is provided on the lower surface or side of the guard piece 15. In one example, the center-position indicator 152 may project downward from the lower surface of the guard piece 15 and extend linearly in the direction y. In plan view (see FIG. 2), the center-position indicator 152 is aligned in line with the first slit 112 of the bottom wall 11.

The guard piece 15 is provided with at least one fixing pin. In the present embodiment, three fixing pins, namely first to third pins 153, are provided on the lower surface of the guard piece 15. The first and second pins 153 are fitted into the front and rear fixing holes 121 formed in the side wall 12 (see FIG. 6). The third pin 153 is fitted into the fixing hole 141 formed in the support wall 14. With the pins 153 fitted into the fixing holes 121 and the fixing hole 141, the guard piece 15 can be detachably attached to the side wall 12 and the support wall 14.

The holder 2 is pivotably connected to the body 1. The holder 2 is provided with a connecting portion 21 and a sewing-machine attaching portion 22. The connecting portion 21 is formed with a connecting hole through which a shaft made of e.g. metal is inserted. The side walls 12 and 13 are provided with holes for receiving the ends of the shaft. With the configuration described above, the connecting portion 21 (and thus the holder 2) is supported by the side walls 12 and 13 so as to be pivotable about the shaft extending in the direction x. FIGS. 1, 2 and 4, for example, show the pivot axis Ox of the shaft.

Figure 8:
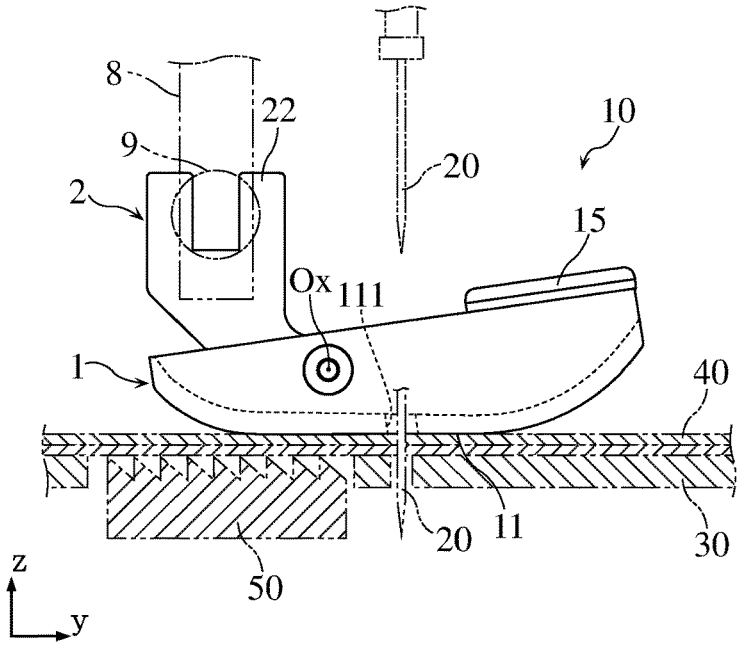
FIG. 8 is a side view showing a use state of the presser foot for a sewing machine.

The sewing-machine attaching portion 22 is connected to the connecting portion 21 and used to attach the holder 2 (and thus the presser foot 10) to a pressing rod 8 of a sewing machine. Specifically, the sewing-machine attaching portion 22 has a recessed groove 221 and a notch 222. As shown in FIGS. 2 and 8 with phantom lines, when the presser foot 10 is used, the pressing rod 8 is inserted into the recessed groove 221. Then, a fixing screw 9 having a threaded shaft 91 is passed through the notch 222 and screwed into a threaded hole 81 of the pressing rod 8. By tightening the fixing screw 9, the sewing-machine attaching portion 22 is (partly) sandwiched between the head of the fixing screw 9 and the pressing rod 8. In this manner, the presser foot 10 can be detachably attached to the pressing rod 8.

The presser foot 10 (the body 1 and the holder 2) may be made from a synthetic resin having an appropriate strength. As described above, the guard piece 15 of the body 1 is formed separately from other parts (the bottom wall 11, the side walls 12 and 13 and the support wall 14). In one example, the body 1 (including the guard piece 15) and the holder 2 are colored and colorless transparent. In another example, the guard piece 15 may be colorless transparent (or colored transparent), while the body 1 (excluding the guard piece 15) and the holder 2 may be made from an opaque material. In a yet another example, the body 1, including the guard piece 15, and the holder 2 may be made from an opaque material. In this case, it is preferable to form the center-position indicator 152 on the upper surface of the guard piece 15.

The following now describes the presser foot 10 in terms of usage examples and advantages with reference to FIG. 8.

When the sewing machine is used, the presser foot 10 is attached to the pressing rod 8 of the sewing machine in the manner described above. In addition, an upper thread (needle thread) and a lower thread (bobbin thread) are threaded through the sewing machine in, for example, a well-known manner. The lower thread needs to be pulled a preterminal length and the pulled end of the thread is passed through the passing hole 111. As described above, the bottom wall 11 has the first slit 112, and the presser foot 10 has the second slit 151. In addition, the guard piece 15 does not overlap with the needle-passing hole 111 (see FIG. 2). With this configuration, by passing the lower thread through the first slit 112 and the second slit 151, the lower thread is easily threaded through the needle-passing hole 111 where stitches are produced.

During the sewing with the sewing machine, fabric 40 placed on a needle plate 30 is pressed down by the presser foot 10 (main body 1) and fed by fabric feeder teeth 50 toward the rear in the direction y. The sewer places his/her hands on the fabric 40 to send the fabric 40 to a position near the sewing-machine needle 20 that is moving up and down. FIG. 8 shows the sewing-machine needle 20 at the highest position and the lowest possible position with phantom lines.

In the present embodiment, the presser foot 10 is provided with the pair of side walls 12 and 13 and the guard piece 15. As can be seen from FIG. 8, the upper end faces of the side walls 12 and 13 are lower than the tip of the sewing-machine needle 20 at its highest position. Note that each of the side walls 12 and 13 is high enough so as not to allow fingers of the sewer to easily slide from the side (i.e. by riding over the side wall) into the space directly under the sewing-machine needle 20. In addition, the guard piece 15 covers the gap between the side walls 12 and 13 from above. The guard piece 15 extends a predetermined length from the front end toward the rear end of the body 1. In one example, the length is determined such that a part of the guard piece 15 overlaps with the flat portion of the bottom wall 11 (see FIG. 8). This configuration prevents fingers of the sewer from entering the space directly under the sewing-machine needle 20.

In this manner, the presser foot 10 can prevent injuries to fingers of the sewer from the sewing-machine needle 20. In addition, the second slit 151 present between the guard piece 15 and the side wall 13 has a width of 1 to 2 mm, which is significantly smaller than the width of any finger of the sewer. This prevents fingers of the sewer from entering the second slit 151 to reach a position near the sewing-machine needle 20.

Unlike the configuration described above, each of the side walls 12 and 13 may be configured to have the upper end face above the tip of the sewing-machine needle 20 raised to the highest position.

In the present embodiment, the guard piece 15 is provided with the center-position indicator 152. In plan view, the center-position indicator 152 extends in the direction y in alignment with the first slit 112. This configuration facilitates sending the fabric 40 in a manner to keep an intended sewing line straight to the sewing-machine needle 20. In the present embodiment, the guard piece 15 is transparent, allowing the center-position indicator 152 to be visible from above.

The presser foot for a sewing machine according to the present disclosure is not limited to the embodiments described above. The specific configuration of each part of the presser foot for a sewing machine may be varied in many ways.

The invention claimed is:

1. A presser foot for a sewing machine, comprising:

a bottom wall having a front end and a rear end and formed with a needle-passing hole and a first slit extending from the needle-passing hole to the front end;

a first side wall and a second side wall that are formed integral with the bottom wall and spaced apart from each other; and a guard piece attached to the first side wall to cover a gap between the first side wall and the second side wall from above, wherein the guard piece is spaced from the needle-passing hole in plan view, the guard piece extends from the first side wall toward the second side wall and terminates short of the second side wall to form a second slit between the second side wall and the guard piece, and an entirety of the guard piece and the second side wall are spaced apart from each other by the second slit in plan view.

2. The presser foot according to claim 1, wherein the first slit has a linear portion that has a constant width and extends in parallel to the second slit in plan view.

3. The presser foot according to claim 2, wherein the guard piece is provided with a linear center-position indicator aligned with the linear portion of the first slit.

4. The presser foot according to claim 1, wherein the guard piece is provided with at least one fixing pin, and the first side wall has a fixing hole engageable with the fixing pin.

5. The presser foot according to claim 1, further comprising a holder detachably attached to a sewing machine, wherein the holder is supported by the first side wall and the second side wall to be pivotable.

6. A presser foot for a sewing machine, comprising:

a bottom wall having a front end and a rear end and formed with a needle-passing hole and a first slit extending from the needle-passing hole to the front end;

a first side wall and a second side wall that are formed integral with the bottom wall and spaced apart from each other; and a guard piece attached to the first side wall to cover a gap between the first side wall and the second side wall from above, wherein the guard piece is spaced from the needle-passing hole in plan view, the guard piece and the second side wall are spaced apart from each other by a second slit, the first slit has a linear portion that has a constant width and extends in parallel to the second slit in plan view, and the guard piece is provided with a linear center-position indicator aligned with the linear portion of the first slit.

* * * * *